US006787982B2

(12) United States Patent
Ryu et al.

(10) Patent No.: US 6,787,982 B2
(45) Date of Patent: Sep. 7, 2004

(54) SIDE BAR FOR FLAT PANEL DISPLAY DEVICE, MANUFACTURING METHOD THEREOF, AND FLAT PANEL DISPLAY DEVICE HAVING SIDE BAR

(75) Inventors: Kyung-Sun Ryu, Seoul (KR); Eung-Joon Chi, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 105 days.

(21) Appl. No.: 10/270,395

(22) Filed: Oct. 15, 2002

(65) Prior Publication Data

US 2003/0071579 A1 Apr. 17, 2003

(30) Foreign Application Priority Data

Oct. 15, 2001 (KR) ..... 2001-63450
Feb. 20, 2002 (KR) ..... 2002-9011

(51) Int. Cl.[7] ..... H01J 1/62

(52) U.S. Cl. ..... 313/493; 313/495; 313/582; 313/634; 313/553

(58) Field of Search ..... 313/493, 495–497, 313/582–587, 512, 546, 547, 561, 562, 634, 513, 573, 422, 553; 315/169.4; 362/561, 31; 445/25

(56) References Cited

U.S. PATENT DOCUMENTS 6,603,260 B1 * 8/2003 Kim et al. ..... 313/562

FOREIGN PATENT DOCUMENTS

KR 1999-43844 6/1999

* cited by examiner

*Primary Examiner*—Vip Patel
*Assistant Examiner*—Glenn Zimmerman
(74) *Attorney, Agent, or Firm*—Robert E. Bushnell, Esq.

(57) ABSTRACT

A side bar for a flat panel display device is disposed between a faceplate and a backplate of the flat panel display device such that it seals the two plates and maintains a constant gap between the two plates. The side bar includes contacting surfaces confronting the facing surfaces of the faceplate and the backplate, and a paste-receiving groove formed on each contacting surface in a longitudinal direction. The paste-receiving groove is provided with adhesive paste for sealing the faceplate to the backplate. The present invention further provides a side bar which has a getter-receiving groove formed thereon adjacent to the paste-receiving groove. The getter-receiving groove is provided with a getter used for improving the vacuum degree of the flat panel display device. The present invention also encompasses a flat panel display device employing the side bar described above, and a method of manufacturing the side bar for a flat panel display device.

32 Claims, 11 Drawing Sheets

SIDE BAR FOR FLAT PANEL DISPLAY DEVICE, MANUFACTURING METHOD THEREOF, AND FLAT PANEL DISPLAY DEVICE HAVING SIDE BAR

CLAIM OF PRIORITY

This application makes reference to, incorporates the same herein, and claims all benefits accruing under 35 U.S.C. §119 from our application entitled SIDE BAR FOR FLAT PANEL DISPLAY DEVICE, MANUFACTURING METHOD THEREOF, AND FLAT PANEL DISPLAY DEVICE HAVING SIDE BAR filed with the Korean Industrial Property Office on Oct. 15, 2001 and there duly assigned Ser. No. 2001-63450, and an application entitled SIDE BAR FOR FLAT PANEL DISPLAY DEVICE, MANUFACTURING METHOD THEREOF, AND FLAT PANEL DISPLAY DEVICE HAVING SIDE BAR filed with the Korean Industrial Property Office on Feb. 20, 2002 and there duly assigned Ser. No. 2002-9011.

BACKGROUND OF THE INVENTION

1. Technical Field

The present invention relates to a flat panel display device, and more particularly, to a side bar used for sealing a faceplate to a backplate while being positioned between the faceplate and the backplate and maintaining a cell gap between the two plates. The present invention also relates to a method of manufacturing the side bar, and to a flat panel display device, in particular to a field emission display device, having the side bar.

2. Related Art

Generally, unlike a cathode ray tube which requires a large space and high voltage, a flat panel display device (FPD) is thin and substantially flat and it can be operated by low voltage. Flat panel display devices include a field emission display device (FED), a vacuum fluorescent display device (VFD), and a plasma display device (PDP).

Each flat panel display device differs in detailed structure depending on its type. However, every type of flat panel display device has electrodes disposed between two opposing plates, and the electrodes are operated to emit electrons. A phosphor layer formed on one of the plates is excited by the emitted electrons, and thus a predetermined pattern can be displayed.

The inner space between the plates is preferably maintained to be a vacuum so as to permit electrons to move easily. In order to maintain the inner space vacuum, the borders of the two plates are sealed with frit or with side bars provided with adhesive paste such as frit.

Side bars have been manufactured by cutting a flat glass plate at regular intervals. Both surfaces of the flat glass plate are provided with adhesive paste.

If the two plates are sealed with such a side bar, the cell gap between the two opposing plates of the flat panel display may not be uniform because of the amount of adhesive paste provided on both surfaces of the side bar. In other words, if more or less than the predetermined amount of adhesive paste is provided, the cell gap may be higher or lower than the predetermined height.

However, if a side bar having a height equivalent to a desired cell gap is employed for sealing, and the amount of adhesive paste provided on the side bar is reduced in order to resolve the above problem, the two plates may not be sufficiently sealed and they may leak.

It is difficult to manufacture a flat panel display which has a uniform gap between the two plates. In the case of a flat panel display having a gap between the two plates which is not uniform, brightness is also not uniform. Further, the pressure is not applied regularly to every spacer but is concentrated at a specific portion, and as a result, the spacer tends to break easily.

In order to improve the vacuum degree by removing gas generated while the electrodes and phosphor layers on the plates are fired, a getter is provided between the two plates or inside the exhaust pipe.

Getters employed for a flat panel display device are classified as evaporation-type getters and non-evaporation-type getters. The evaporation-type getter is being widely used for VFDs because of its low cost, but it generates particles during the activation process, it requires a substantial space to evaporate and deposit, and the activation temperature is relatively high. Hence, interest is now being focused on the non-evaporation-type getter.

A non-evaporation-type getter includes various types, such as a band-type and a ring-type. Due to convenience of use and low activation temperature, the band-type getter is widely employed for various fields.

There are basically two methods of providing a getter for a flat panel display. One is a method of providing the getter in an extra space outside the panel, and the other is a method of providing the getter in a space inside the panel.

Japanese Patent Laid-Open No.9-129161 discloses an FED according to a method of providing the getter in an extra space outside the panel. In this FED, first and second substrates are provided, a getter chamber is provided at the bottom of the second substrate, and the inner space between the first substrate and the second substrate communicates with the getter chamber via a connecting hole formed on the second substrate. An exhaust port is formed on the bottom of a glass which forms the getter chamber, and an exhaust tube is connected to the exhaust port. The getter is provided in the interior of the getter chamber using a getter support tool.

The getter support tool comprises a base section which has a band shape that is longer than the circumference of the getter, a hold section which is bent in a direction perpendicular to the surface of the base section and which grasps the getter from above and below, and support legs which are formed in one body with the base section and that maintain the getter at a predetermined height in the getter chamber.

Therefore, the amount by which the display in such a flat panel display as described above can be made thinner is limited because the getter chamber and the exhaust tube are provided at the bottom of the second substrate.

Further, the hold section must be bent for providing the getter to the getter support tool, and when the getter is provided inside the getter chamber, one of the support legs must be fixed on the getter chamber to prevent the getter support tool from deviating from its original position. Hence, it is inconvenient to fix the getter in the display device.

Korean Patent Laid-Open No.1999-43844 discloses another method of holding and activating a getter of an FED.

The method comprises forming a getter chamber and an exhaust tube on one side of a panel when manufacturing a flat panel display by aligning an upper substrate with a lower substrate and sealing them together, inserting the getter into the getter chamber after fixing the getter on a dummy wire by welding, enveloping the exhaust tube with the dummy wire by melting the exhaust tube, and activating the getter by heating after a process of exhaust and tip-off.

According to the above method, the flat panel display can be thinner than in the former case. However, a section of exhaust tube must be fixed on each side of the substrate, and the getter welded to the dummy wire must be inserted into the getter chamber through the exhaust tube. Hence, it is still inconvenient to fix the getter in the display device. Further, the quality of image display may be deteriorated due to the effects of heat on the substrate when the exhaust tube is melted using a torch.

When the getter is provided to the inner space of the panel, an extra structure, such as a metal wire or a getter holder, is usually employed to fix the getter. However, by using such an extra structure, the length of the process may increase and unnecessary space in addition to the effective area may also increase.

SUMMARY OF THE INVENTION

It is an object of the present invention to provide a side bar and a method of manufacturing thereof, which is capable of sealing a faceplate to a back plate of a flat panel display device and of maintaining a constant cell gap between two plates.

It is another object of the present invention to provide a side bar, and a method of manufacturing thereof, which has a getter-receiving portion in its body, and which is capable of sealing a faceplate to a back plate of a flat panel display device.

It is another object of the present invention to provide a flat panel display device having the above side bar. Because of such side bar, a non-effective area may be minimized and the process of providing the getter may be simplified.

A side bar for a flat panel display device according to a preferred embodiment of the present invention includes: contacting surfaces confronting the facing surfaces of the faceplate and the backplate of the flat panel display device; and at least one paste-receiving groove formed on each of the contacting surfaces in a longitudinal direction, the paste-receiving groove receiving adhesive paste for sealing the faceplate to the backplate of the flat panel display device.

The paste-receiving groove has a cross section selected from the group consisting of a wedge-shaped cross section, a semicircular cross section, and a rectangular cross section.

The paste-receiving groove may be formed so as to have one of the walls of the paste-receiving groove open.

The adhesive paste is provided to the paste-receiving groove so as to have a protrusion along the center of the adhesive paste, the protrusion being higher than the contacting surface of the side bar.

A method of manufacturing a side bar for a flat panel display device according to a preferred embodiment of the present invention includes: providing a plate; forming a plurality of paste-receiving grooves on the plate at regular intervals, the paste-receiving grooves receiving adhesive paste for sealing the faceplate to the backplate of the flat panel display device; disposing the adhesive paste in the paste-receiving grooves such that the adhesive paste has substantially the same height as the surface of the plate; drying the adhesive paste disposed in the paste-receiving grooves; disposing adhesive paste on the top surface of the adhesive paste disposed in the paste-receiving grooves so as to form protrusions along the top surface of the adhesive paste disposed in the paste-receiving grooves, the protrusion being higher than the surface of the plate; drying the adhesive paste disposed on the top surface of the adhesive paste disposed in the paste-receiving grooves; firing the plate with the disposed adhesive paste; and cutting the plate into a plurality of units, each unit including at least one paste-receiving groove.

A side bar for a flat panel display device according to another embodiment of the present invention includes: contacting surfaces confronting the facing surfaces of the faceplate and the backplate of the flat panel display device; at least one paste-receiving groove formed on each contacting surface in a longitudinal direction, the paste-receiving groove receiving adhesive paste for sealing the faceplate to the backplate of the flat panel display device; and at least one getter-receiving groove formed adjacent to the paste-receiving groove, the getter-receiving groove receiving a getter that is used for improving a vacuum degree of the flat panel display device.

The side bar may further comprise a communicating groove by which the getter-receiving groove communicates with an effective area of the flat panel display device that is to realize images. The communicating groove has side walls which can prevent the getter from deviating from the communicating groove.

The side bar may further comprise at least one wire-receiving groove formed so as to extend from the getter-receiving groove and to cross the paste-receiving groove, the wire-receiving groove receiving a metal wire for heating the getter.

The getter-receiving groove is formed into a unitary groove along the side bar in the longitudinal direction. Alternatively, the getter-receiving groove comprises a plurality of circular or rectangular-shaped grooves.

A method of manufacturing a side bar for a flat panel display device according to another embodiment of the present invention includes: providing a plate; forming a plurality of paste-receiving grooves at regular intervals and at least one getter-receiving groove adjacent to each paste-receiving groove on the plate, the paste-receiving groove receiving adhesive paste for sealing the faceplate to the backplate of the flat panel display device; and cutting the plate into a plurality of units, each unit including at least a paste-receiving groove and the getter-receiving groove that is adjacent to the paste-receiving groove.

The method of manufacturing a side bar may further comprise: forming a plurality of paste-receiving grooves and getter-receiving grooves on the plate; disposing the adhesive paste in the paste-receiving grooves; drying the adhesive paste disposed in the paste-receiving grooves; and firing the plate with the disposed adhesive paste.

A flat panel display device according to an embodiment of the present invention includes: a backplate and a faceplate which face each other; a cathode electrode provided on the backplate; an emitter provided on the cathode electrode, the emitter emitting electrons when an electric field is formed around the emitter; an anode electrode provided on the faceplate; a phosphor layer provided on the anode electrode, the phosphor layer being excited by the electrons emitted from the emitter and emitting light; and a side bar for sealing the faceplate to the backplate while being disposed between the faceplate and the backplate and maintaining a constant cell gap between the two plates.

The side bar includes: contacting surfaces confronting the facing surfaces of the faceplate and the backplate; and at least one paste-receiving groove formed on each contacting surface in a longitudinal direction, the paste-receiving groove(s) receiving adhesive paste for sealing the faceplate to the backplate.

The flat panel display device may further comprise at least one getter-receiving groove formed adjacent to the paste-receiving groove, the getter-receiving groove receiving a getter that is used for improving a vacuum degree of the flat panel display device and being directed to an effective area of the flat panel display device that is to realize images.

The adhesive paste is preferably provided on the paste-receiving groove such that the center portion of the adhesive paste is higher than the contacting surface of the side bar and the circumferential portion of the adhesive paste is lower than the contacting surface of the side bar.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Preferred embodiments of this invention will be explained with reference to the accompanying drawings.

Figure 1:
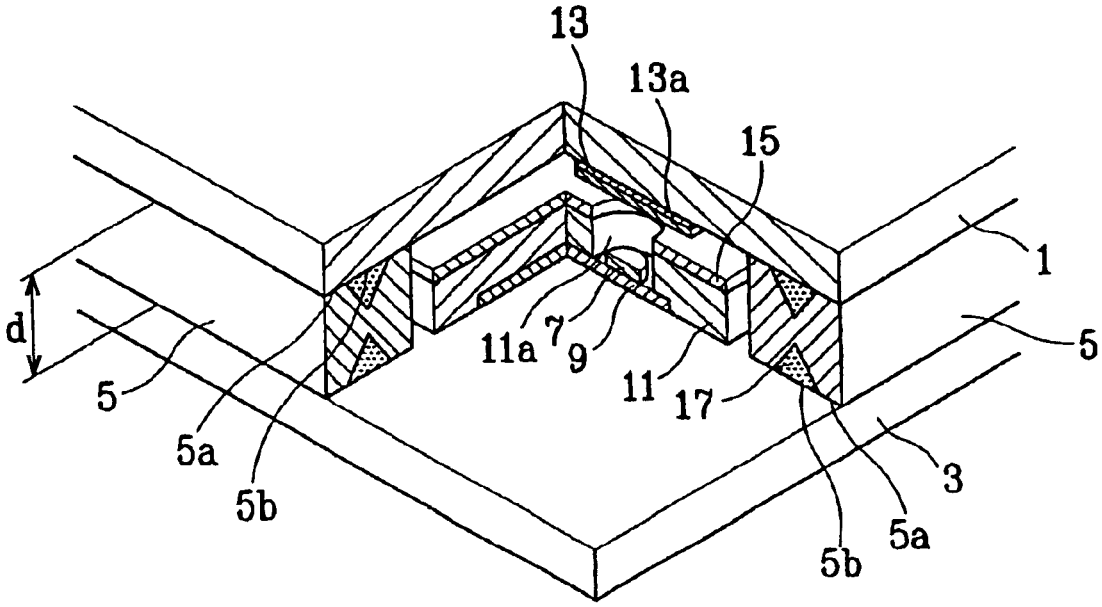
FIG. 1 is a partial cutaway perspective view of a flat panel display device provided with a side bar according to a first embodiment of the present invention.

Referring to FIG. 1, a flat panel display device according to the present invention, in particular an FED, includes a faceplate 1 and a backplate 3, the plates 1 and 3 being disposed parallel to each other with a predetermined gap therebetween. A side bar 5 is interposed between the faceplate 1 and the backplate 3 so as to seal and maintain the predetermined gap between the two plates.

A light-emitting means is provided in the interior of such an FED. The light-emitting means comprises a cathode electrode 9 formed on the backplate 3, an insulation layer 11 formed on the cathode electrode 9, and an anode electrode 13 formed on the faceplate 1 confronting the backplate 3. The cathode electrode 9 has an electron-emitting source 7 on its surface, and the insulation layer 11 has a plurality of holes 11*a* corresponding to the electron-emitting source 7 so as to expose the electron-emitting source 7 in the direction of the faceplate 1. A phosphor layer 13*a* is formed on the surface of the anode electrode 13.

More particularly, on the faceplate 1, an R, G, B phosphor layer 13*a* is disposed beneath the anode electrode 13, and on the backplate 3, the electron-emitting source 7 is formed in a predetermined pattern on the cathode electrode 9, the electron-emitting source 7 being substantially an emitter for emitting light by striking electrons on the phosphor layer 13*a*.

The insulation layer 11 is disposed on the cathode electrode 9 and has a plurality of holes 11*a* corresponding to the electron-emitting source 7. The insulation layer 11 is preferably made of a photosensitive insulation material capable of exposure and etching with light.

A gate electrode layer 15, which is made of Al, Cr, or Ag, is formed on the insulation layer 11.

The side bar 5 includes contacting surfaces 5*a* contacting the facing surfaces of the faceplate 1 and the backplate 3 of the FED, and a paste-receiving groove 5*b* is formed on a part of each contacting surface 5*a*. An adhesive paste 17 is provided in the paste-receiving groove 5*b* so as to seal the faceplate 1 to the backplate 3.

Referring to FIG. 1, the paste-receiving groove 5*b* is disposed at the center portion of both contacting surfaces 5*a*, and is formed as a wedge-shaped groove in a longitudinal direction of the side bar 5.

The adhesive paste 17 is provided in the paste-receiving groove 5*b*, and is contacted to a surface of the faceplate 1 and a surface of the backplate 3 when the side bar 5 is interposed between the faceplate 1 and the backplate 3.

The cell gap of the FED can be maintained constant since the side bar 5, which is uniform in height, is disposed between the faceplate 1 and the backplate 3 so as to contact the facing surfaces of the two plates.

The side bar 5 can be adhered to both the faceplate 1 and the backplate 3 by the adhesive paste 17 provided in the paste-receiving groove 5*b*.

As described above, the adhesive paste 17 is provided on a part of the confronting surfaces of the side bar 5, instead of on the entire confronting surface of the side bar 5, and the rest of the confronting surface of the side bar 5 is brought into direct contact with the faceplate 1 and the backplate 3 such that the cell gap of the FED can be maintained constant.

The specification of the contacting surface 5*a* and the paste-receiving groove 5*b* of the side bar 5 may be determined as follows.

It is preferable that the paste-receiving groove 5*b* be narrow so as to reduce a dead area of the display. It is also preferable that the contacting surface 5*a* be narrow, but the probability of having a vacuum leak occur inside the FED becomes high if the contacting surfaces 5*a* are excessively narrow.

In an embodiment of the present invention, when the side bar 5 is 3 mm in width, the contacting surface 5*a* is 1 mm in width and the paste-receiving groove 5*b* is 2 mm in width.

It is preferable that the depth of the paste-receiving groove 5*b* be half the total height of the side bar 5. In an embodiment of the present invention, when the FED has a cell gap of 1.1 mm, the paste-receiving groove 5*b* is formed on both surfaces of the side bar 5 at the depth of 0.3 mm.

Hereinafter, another embodiment of the present invention is described.

Figure 2:
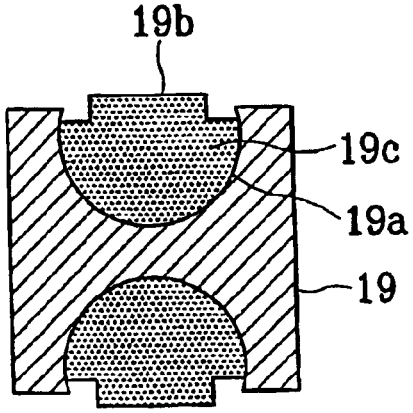
FIGS. 2 thru 5 are cross-sectional views of side bars for a flat panel display device according to second through fifth embodiments of the present invention.
Figure 3:
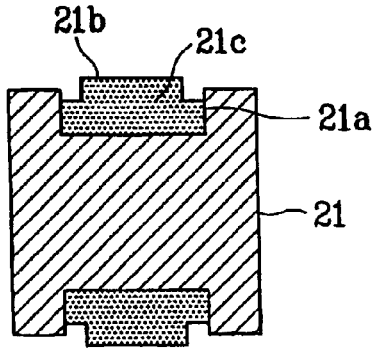

FIGS. 2 and 3 are cross-sectional views of side bars for a flat panel display device according to a second embodiment and a third embodiment, respectively, of the present invention.

As shown in FIGS. 2 and 3, side bars 19 and 21 have 'H'-shaped cross sections. More particularly, the paste-receiving groove 19*a* according to a second embodiment shown in FIG. 2 has a semicircular cross section, and the paste-receiving groove 21*a* according to the third embodiment shown in FIG. 3 has a rectangular cross section. Adhesive paste 19*c* and 21*c* is provided in the paste-receiving grooves 19*a* and 21*a,* respectively.

Figure 4:
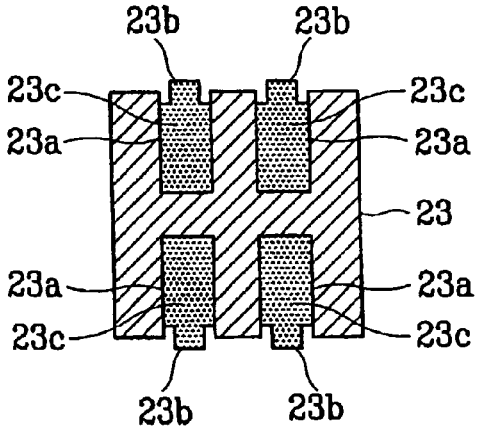

FIG. 4 shows a cross section of a side bar according to a fourth embodiment of the present invention. At least two paste-receiving grooves 23*a* are formed on each of the upper and lower surfaces of the side bar 23 along the longitudinal direction, and each groove has a rectangular cross section. Adhesive paste 23*c* is provided in each paste-receiving grooves 23*a*.

Figure 5:
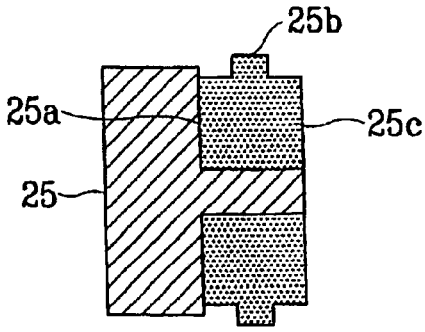

FIG. 5 shows a side bar 25 according to a fifth embodiment of the present invention, and paste-receiving grooves 25*a* are formed thereon such that one wall of each is open. It is preferable that the open sides of the paste-receiving grooves 25*a* face the inner space of the FED.

In the side bars according to all the above embodiments of the present invention, the adhesive paste is provided in the paste-receiving grooves such that protrusions 19*b,* 21*b,* 23*b,* and 25*b* are formed in the center thereof. The protrusions 19*b,* 21*b,* 23*b,* and 25*b* are higher than the contacting surface of the side bar.

FIGS. 6A thru 6F show perspective views illustrating a method, by steps, of manufacturing a side bar according to a first embodiment of the present invention.

Figure 6A:
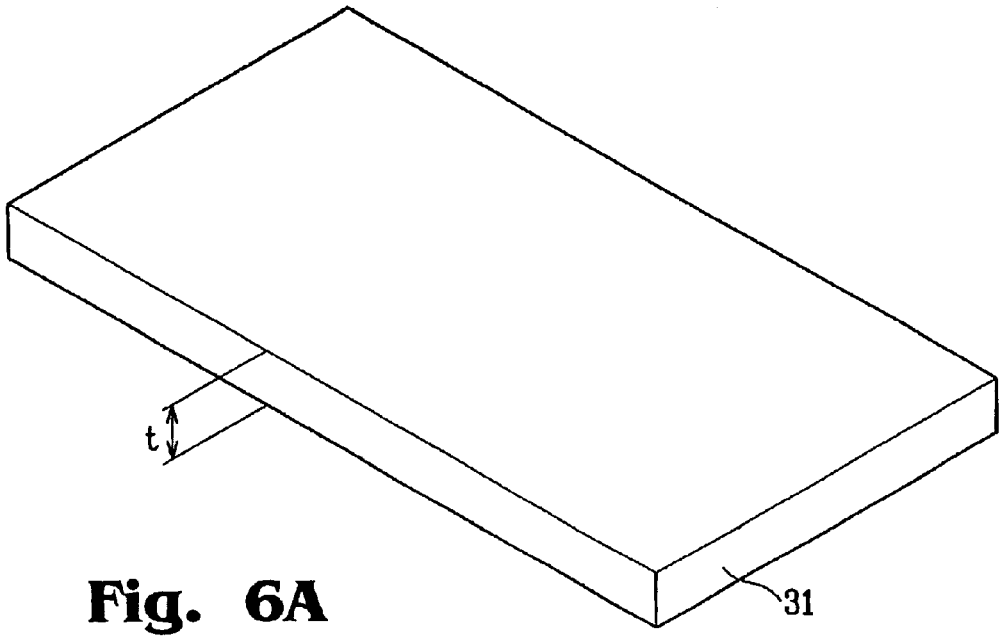
FIGS. 6A thru 6F are perspective views illustrating a method, by steps, of manufacturing a side bar according to a first embodiment of the present invention.
Figure 6B:
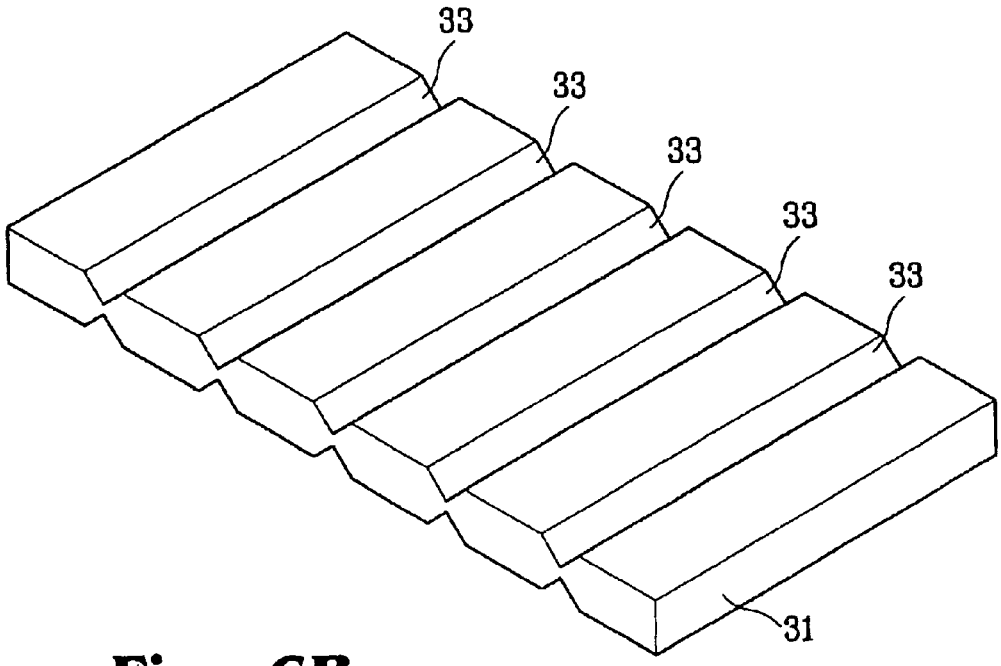

As shown in FIG. 6A, a plate 31 having a thickness t equal to the gap d (referring to FIG. 1) between the faceplate 1 and the backplate 3 is provided. Then, as shown in FIG. 6B, paste-receiving grooves 33 are formed on both surfaces of the plate 31 at regular intervals. The paste-receiving grooves 33 are to be provided with the adhesive paste. A glass plate may be employed for the plate 31, and the paste-receiving grooves 33 may be formed by etching or mechanical grinding.

Figure 6C:
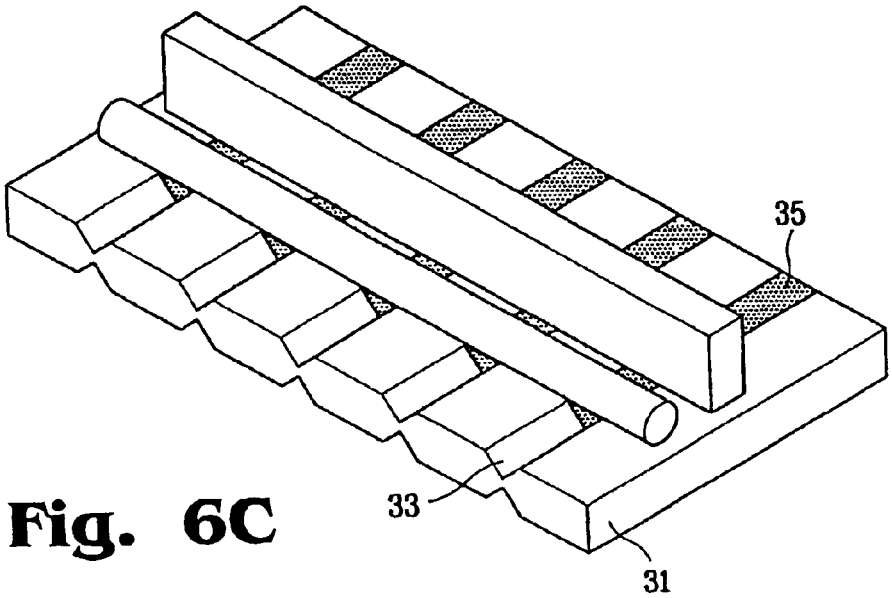

As shown in FIG. 6C, coats of adhesive paste 35 are provided in the paste-receiving grooves 33 and then dried.

Specifically, the adhesive paste 35 is repeatedly provided to the paste-receiving grooves 33 by a printing or dispensing process and then dried until the paste is equal in height to the surface of the plate 35.

Figure 6D:
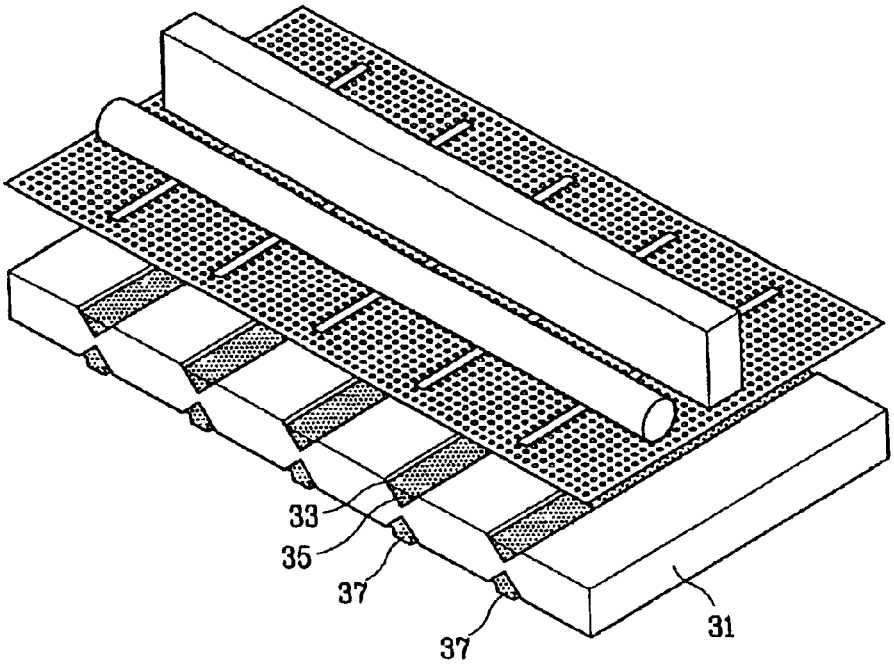

As shown in FIG. 6D, additional adhesive paste is provided on the adhesive paste 35 by the printing or dispensing process, to form a linear shape, and then it is dried to form protrusions 37 on the adhesive paste 35. It is preferable that the material used for the protrusions is the same as that of the adhesive paste 35.

Figure 6E:
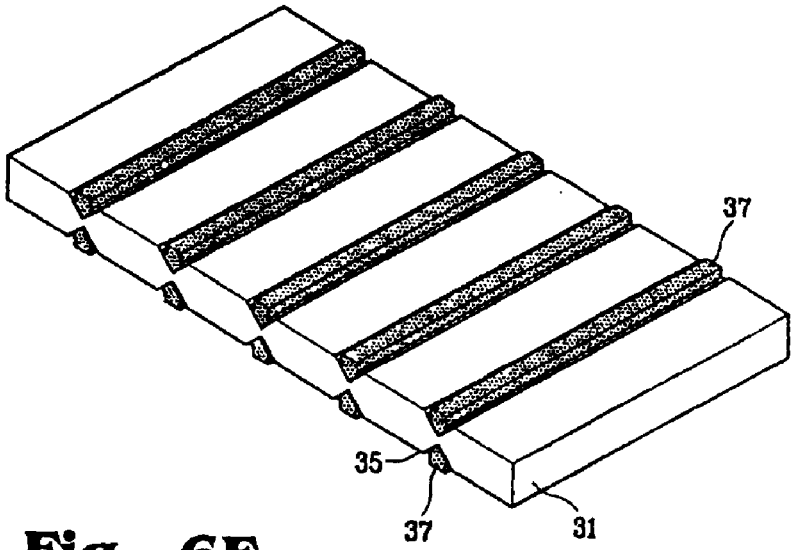
Figure 6F:
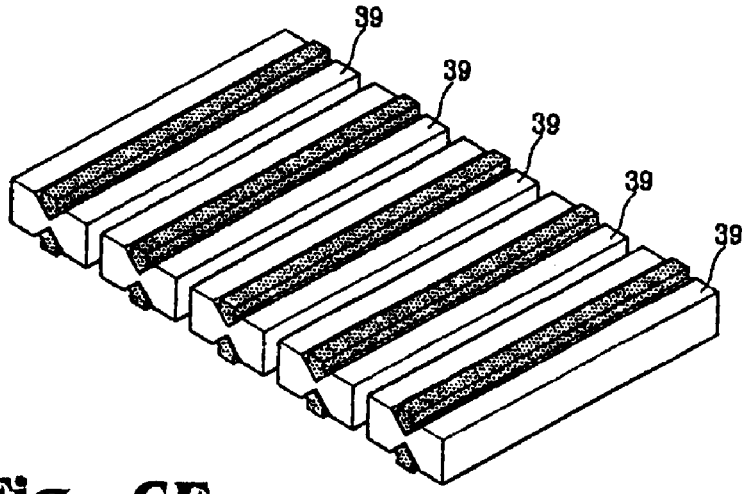

The protrusions 37 are formed on the adhesive paste 35 because the adhesive paste 35 becomes lower than the surface of the plate 31 due to volume reduction that occurs while firing the paste, which takes place after the adhesive paste application. The protrusions 37, however, maintain a height that is greater than that of the surface of the plate 31 (FIG. 6E).

The plate 31 is then cut at regular intervals into a plurality of units, each of which includes at least two paste-receiving grooves 33 provided with adhesive paste 35. Each unit is employed as a side bar 39 for a flat panel display device (referring to FIG. 6F).

A side bar according to the embodiment of the present invention as described above allows its contacting surfaces to adhere closely to both the faceplate and the backplate. Hence, the flat panel display device can maintain a constant cell gap between the two plates so that electrons emitted from an electron-emitting source hit exactly at their predetermined phosphors. As a result, the quality of the display can be improved.

Further, since the adhesive paste is provided within the paste-receiving grooves, the adhesive paste can be prevented from being pushed out to the side of the flat panel display device by the side bar and the two plates.

Since the process of providing and drying the adhesive paste is repeated at least twice, a greater amount of adhesive paste is provided than in prior arrangements, and leaks may be diminished in the inventive flat panel display device.

Figure 7:
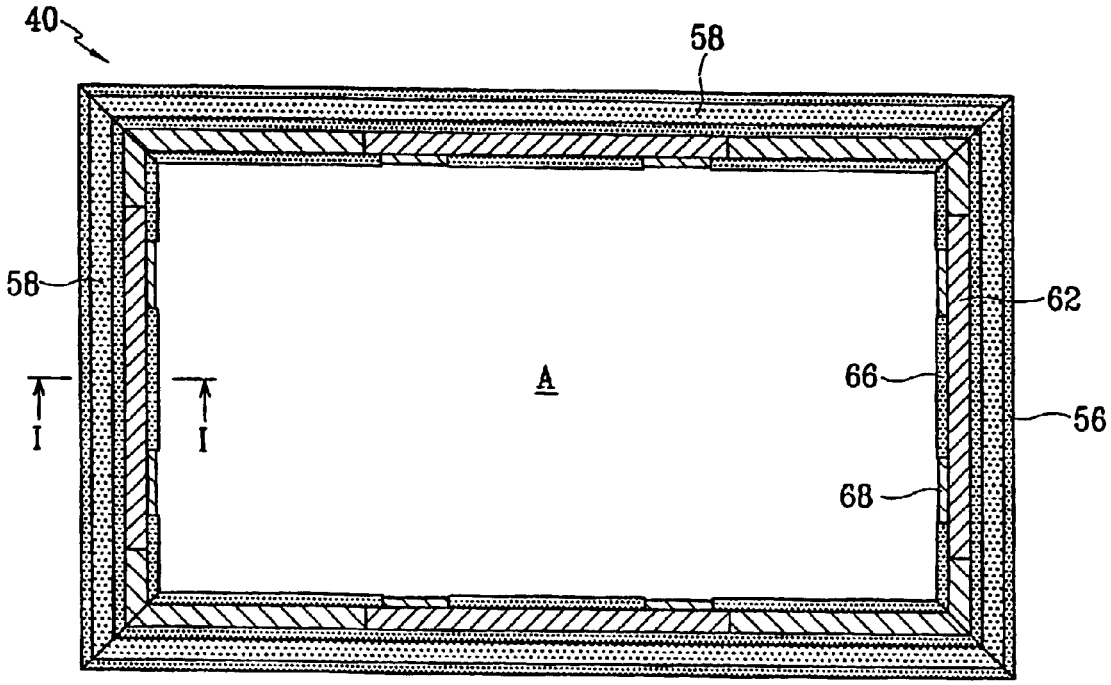
FIG. 7 is a plan view of a flat panel display device employing a side bar according to an embodiment of the present invention.
Figure 8:
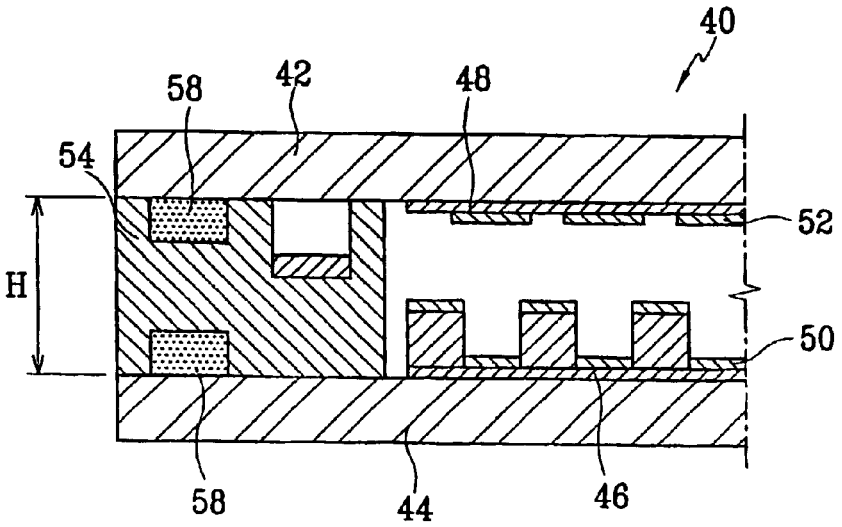
FIG. 8 is a cross sectional view taken along the line I—I of FIG. 7.
Figure 9:
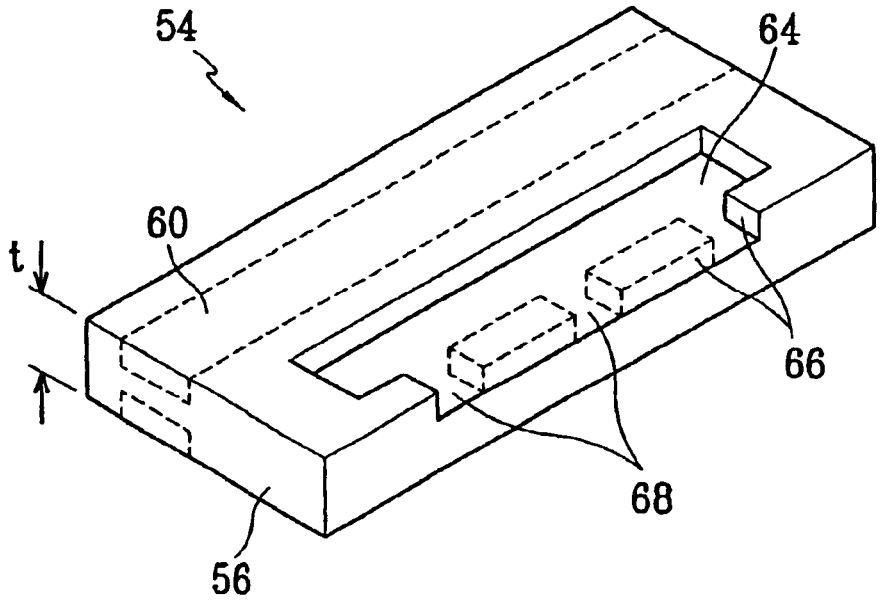
FIGS. 9 thru 13 are perspective views of side bars for a flat panel display device according to sixth through tenth embodiments of the present invention.

FIG. 7 is a plan view of a flat panel display device, in particular an FED, employing a side bar according to an embodiment of the present invention, and FIG. 8 is a cross-sectional view taken along the line I—I of FIG. 7. FIG. 9 is a perspective view of the side bar shown in FIGS. 7 and 8.

The FED 40 includes a faceplate 42 and a backplate 44, which are provided with a display section constituting an effective area A, an electron-emitting section, and electrodes for driving the effective area and the electron-emitting section. Particularly, cathode electrodes 46 are linearly provided on the backplate 44, and anode electrodes 48 are linearly provided on the faceplate 42 so as to intersect with the cathode electrodes 46 at right angles.

A surface-type emitter 50, which is composed of electron-emitting materials, is disposed on the surface of the cathode electrode 46, and a phosphor layer 52 is disposed on the surface of the anode electrodes 48 confronting the emitter 50. The emitter 50 may be of a cone-shaped spindt type.

A side bar 54 is interposed between the faceplate 42 and the backplate 44 along the circumference thereof. The side bar 54 is made of a plate 56 having a thickness t that is equal to or analogous to the gap H between the faceplate 42 and the backplate 44, and it includes a paste-receiving section 60 provided with adhesive paste 58 and a getter-receiving groove 64 provided with a getter 62. The adhesive paste 58 is for sealing the display device, and the getter 62 is for improving the vacuum degree of the inner space of the display device by absorbing the remaining gas after an exhaust process.

Glass plate is preferably chosen for the plate 56, and frit is preferably chosen for the adhesive paste 58.

The upper and lower surfaces of the plate 56 may be used as they are for the paste-receiving section 60 as indicated by the broken line in FIG. 9, or a paste-receiving groove 64 may be formed on the plate 56 for receiving the adhesive paste. The getter-receiving groove 64 has communicating grooves 68 to communicate with the effective area A between the two plates 42 and 44, and each communicating groove 68 may have a side wall 66 which can prevent the getter 62 from deviating from the communicating groove 68.

End surfaces of the side bar 54 shown in FIG. 9 are perpendicular to the longitudinal direction of the side bar 54, but this is not essential to the present invention, and thus both end surfaces of the side bar 54 can be slanted.

A non-evaporation-type getter may be employed as the getter 62 which is provided in the getter-receiving groove 64. A non-evaporation-type getter absorbs gas remaining during the process of aging at a high temperature for activating the remaining gas after exhaust. The absorption of the remaining gas starts at somewhat more than 250 degrees, at which the remaining gas begins diffusing, and it is carried out most effectively at 350~450 degrees.

The non-evaporation-type getter may be made from the compound metal ST 101, which is produced by mixing zirconium with aluminum at a predetermined weight ratio (for example, zirconium 84 wt % and aluminum 16 wt %). A band-type getter which is coated with a powder of the compound metal ST 101 may be provided to the getter-receiving groove 64.

Figure 10:
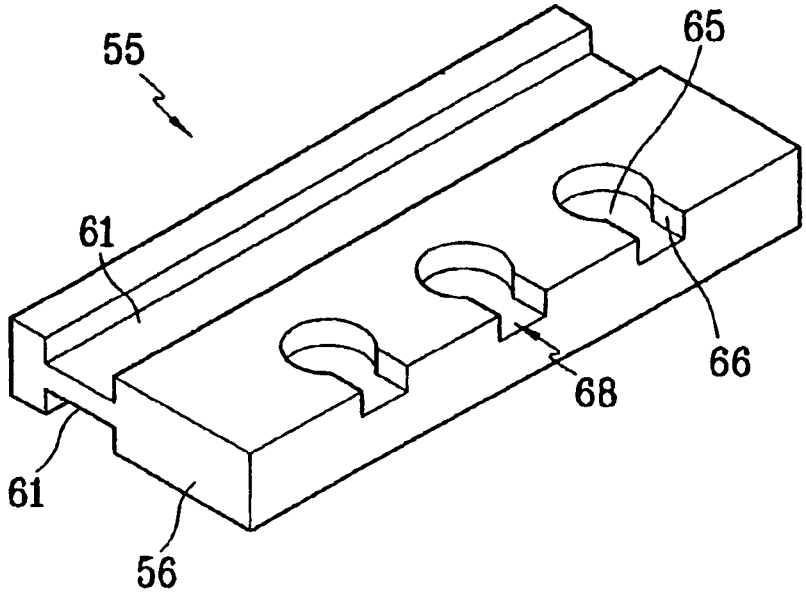
Figure 11:
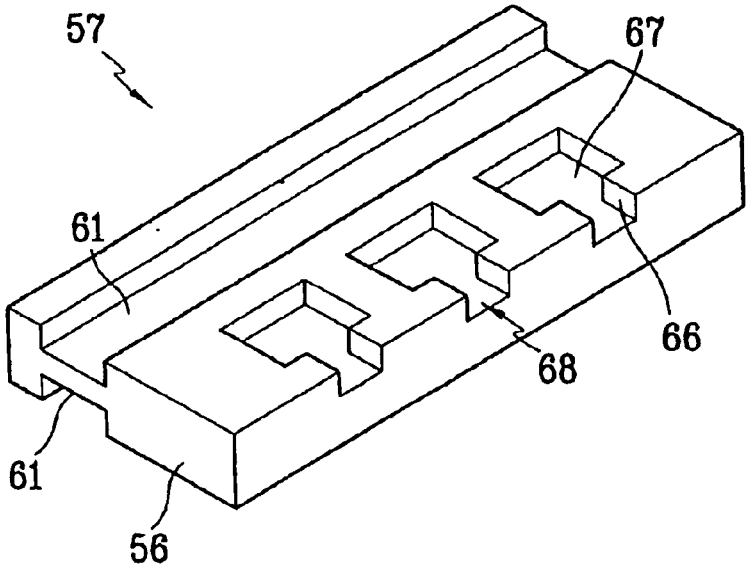
Figure 12:
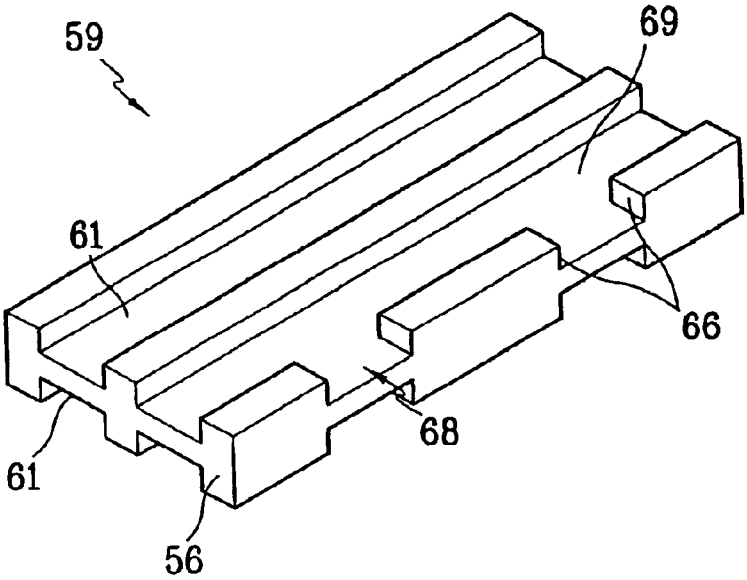

FIGS. 10 thru 12 are perspective views of side bars according to seventh thru ninth embodiments of the present invention, respectively. A getter-receiving groove 65 formed on a side bar 55 shown in FIG. 10 is a circular groove, and a getter-receiving groove 67 formed on a side bar 57 shown in FIG. 11 is a rectangular groove. A getter-receiving groove 69 formed on a side bar 59 shown in FIG. 12 extends to the end surfaces thereof. Other features of the side bars shown in FIGS. 10 thru 12 are analogous to that of the side bar shown in FIG. 9, and so a detailed description thereof is omitted.

Figure 13:
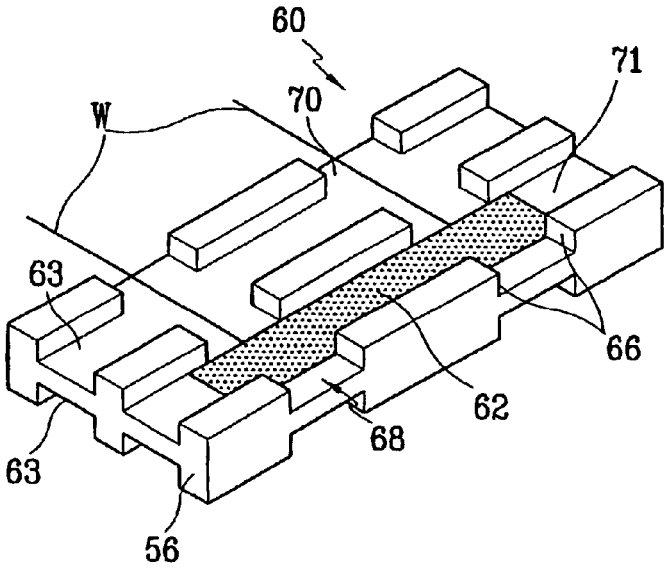

FIG. 13 is a perspective view of a side bar according to a tenth embodiment of the present invention. The side bar 60 shown in FIG. 13 may be employed when the getter is activated by an electric current.

To activate the getter 62 by an electric current, a metal wire W for heating the getter 62 is required to extend to the outside of the display device. Thus, the side bar 60 shown in FIG. 13 has a wire-receiving groove 70 which is formed so as to extend from the getter-receiving groove 71 and to cross the paste-receiving groove 63. The metal wire W is connected to the getter 62 through the wire-receiving groove 70, and the adhesive paste, such as frit, is provided to the wire-receiving groove 70 and the paste-receiving groove 63 so as to seal the faceplate to the backplate.

With the side bar as described above, the probability of a vacuum leak due to the metal wire W is much lower than with in prior arrangements. In addition, the gap between the two plates can be prevented from changing because the metal wire W is buried in the frit.

If the side bar in accordance with the present invention is employed for a flat panel display device, particularly for an FED, the process of providing the getter becomes simplified, the getter requires a minimal space, and thus a non-effective area can be minimized.

Hereinafter, the method of manufacturing the side bar shown in FIG. 12 is described.

The methods of manufacturing the side bar are classified into the case of producing one bar from one plate, and the case of producing a plurality of bars from one plate.

Figure 14A:
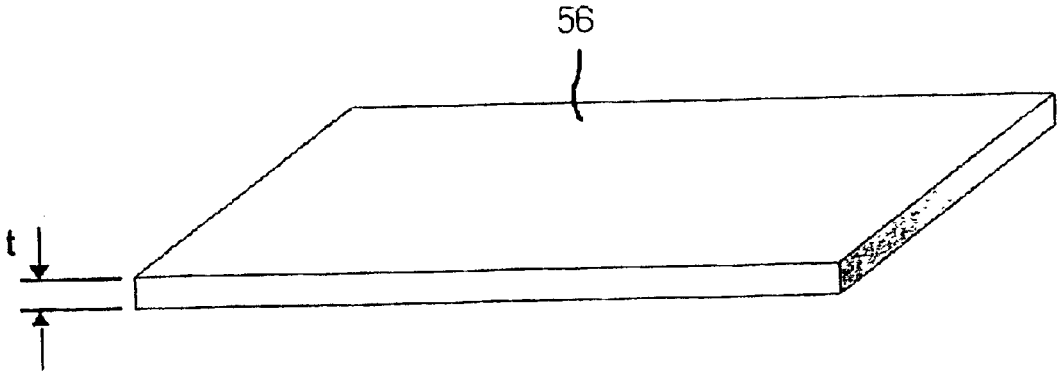
FIGS. 14A thru 14E are perspective views illustrating a method, by steps, of manufacturing a side bar according to a ninth embodiment of the present invention.

The latter case is described hereinafter referring to FIG. 8 and FIGS. 14A to 14E. First, as shown in FIG. 14A, a glass plate 56 having a predetermined thickness t is provided. It is preferable that the thickness t of the glass plate 56 be equal or analogous to the gap between the faceplate 42 and the backplate 44.

Figure 14B:
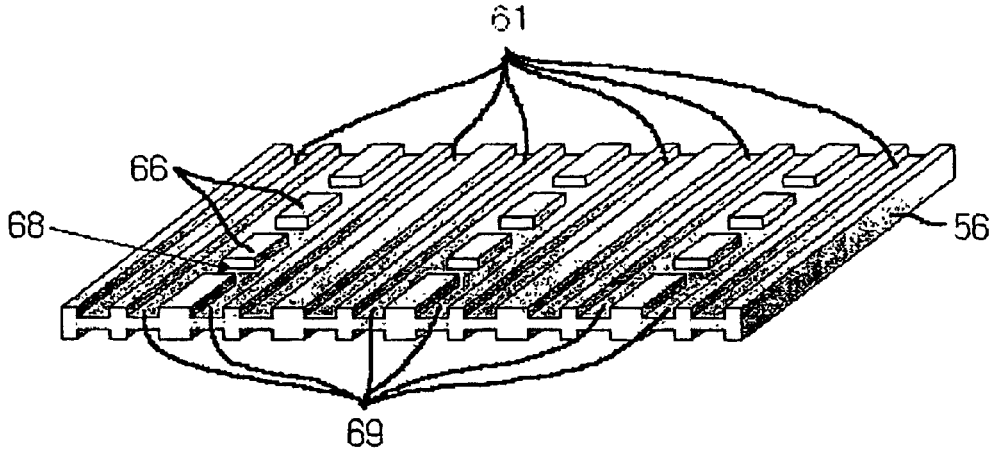

Subsequently, as shown in FIG. 14B, a plurality of groove units are formed on the glass plate 56 at regular intervals by etching or mechanical grinding such that each groove unit includes at least a paste-receiving groove 61 on both surfaces of the glass plate 56 and at least one getter-receiving groove 69 adjacent thereto. The getter-receiving grooves 69 may be formed on either surface of the glass plate 56, and they each preferably have a communicating groove 68 including a side wall 66.

Figure 14C:
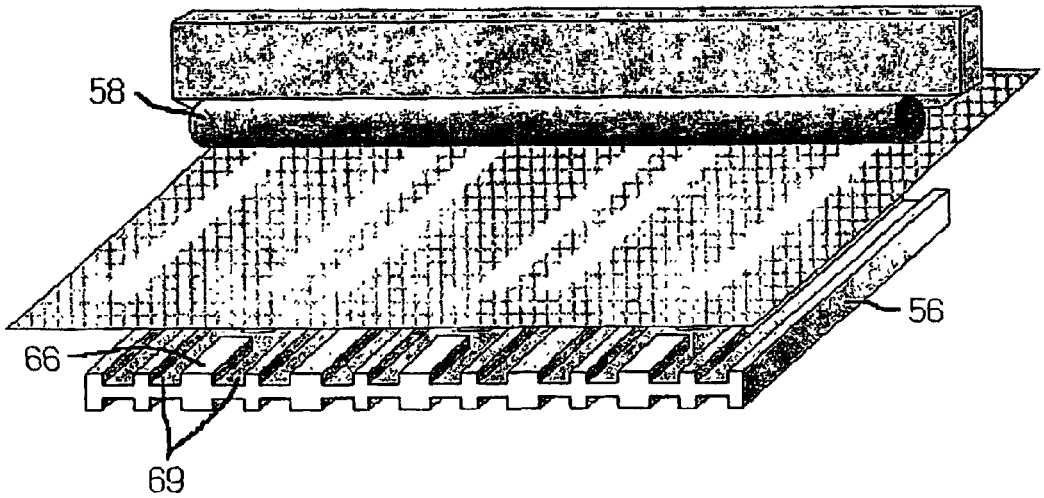

As shown in FIG. 14C, the frit 58 is provided on the paste-receiving groove 61 of the glass plate 56 by printing or dispensing, and is dried.

Figure 14D:
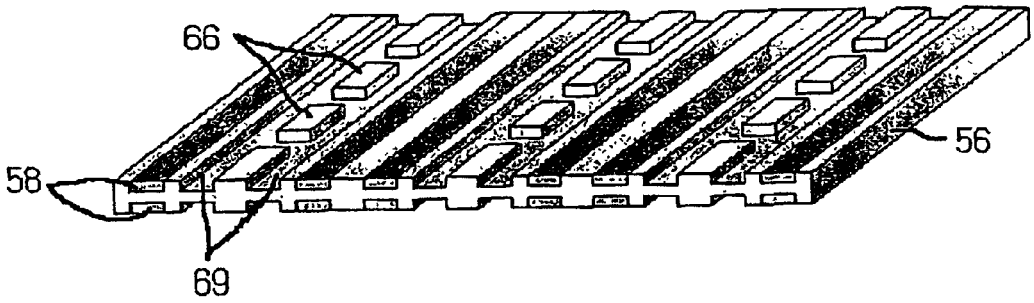

After the paste-receiving groove 60 is filled with the fit 58 as shown in FIG. 14D, the glass plate 56 is fired.

Figure 14E:
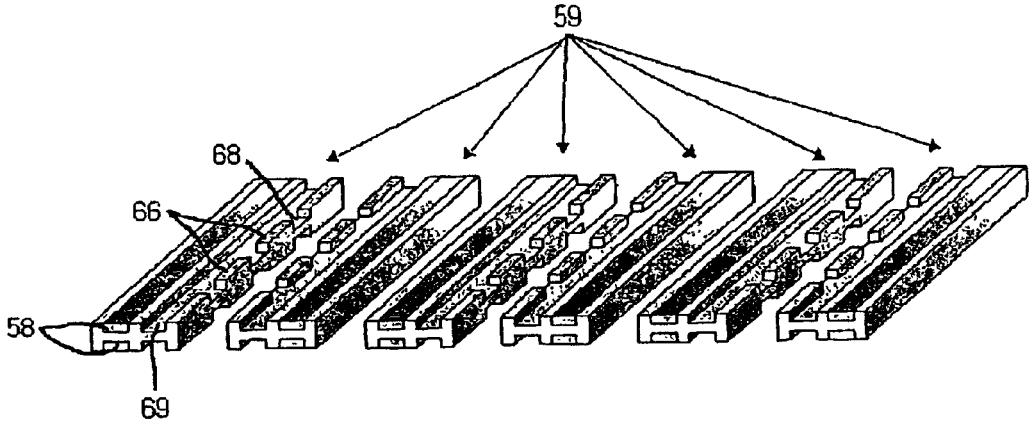

Then, as shown in FIG. 14E, the glass plate 56 is cut into individual groove units, each of which includes at least a paste-receiving groove 61 on both surfaces of the glass plate 56 and a getter-receiving groove 69 adjacent thereto.

According to the method of manufacturing side bars shown in FIGS. 14A thru 14E, a large quantity of side bars can be manufactured at the same time, and thus productivity can be improved.

The former case of producing a side bar is substantially the same as the latter case of producing a plurality of side bars, except that a glass plate having a predetermined width that is equal to that of a side bar is provided.

When a side bar having the getter-receiving groove in its body as described above is employed for a flat panel display device, the process of providing the getter can be performed more conveniently. In addition, although the non-effective area is minimized, the vacuum degree can be improved, and thereby the area of a flat panel display device can be enlarged.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A side bar for sealing a faceplate to a backplate of a flat panel display device while being disposed between the faceplate and the backplate and maintaining a constant cell gap between the two plates, comprising:

contacting surfaces confronting facing surfaces of the faceplate and the backplate of the flat panel display device; and at least one paste-receiving groove formed on each of the contacting surfaces in a longitudinal direction, each said at least one paste-receiving groove receiving adhesive paste for sealing the faceplate to the backplate of the flat panel display device.

2. The sidebar of claim 1, wherein each said at least one paste-receiving groove has a cross section which comprises one of a wedge-shaped cross section, a semicircular cross section, and a rectangular cross section.

3. The side bar of claim 1, wherein each said at least one paste-receiving groove has at least one wall which is open.

4. The side bar of claim 1, wherein the adhesive paste is provided to said at least one paste-receiving groove so as to have a protrusion along a center of the adhesive paste, the protrusion being higher than the contacting surfaces of the side bar.

5. A method of manufacturing a side bar for sealing a faceplate to a backplate of a flat panel display device, said side bar being disposed between the faceplate and the backplate and maintaining a constant cell gap between the faceplate and the backplate, said method comprising:

providing contacting surfaces confronting facing surfaces of the faceplate and the backplate of the flat panel device; and forming at least one paste-receiving groove on each of the confronting surfaces in a longitudinal direction, each said at least one paste-receiving groove receiving adhesive paste for sealing the faceplate to the backplate of the flat panel display device.

6. A side bar for sealing a faceplate to a backplate of a flat panel display device while being disposed between the faceplate and the backplate and maintaining a constant cell gap between the two plates, comprising:

a paste-receiving portion confronting facing surfaces of the faceplate and the backplate of the flat panel display device for receiving adhesive paste for sealing the faceplate to the backplate; and at least one getter-receiving groove formed adjacent to the paste-receiving portion, the getter-receiving groove receiving a getter that is used for improving a vacuum degree of the flat panel display device.

7. A side bar for sealing a faceplate to a backplate of a flat panel display device while being disposed between the faceplate and the backplate and maintaining a constant cell gap between the two plates, comprising:

contacting surfaces confronting facing surfaces of the faceplate and the backplate of the flat panel display device;

at least one paste-receiving groove formed on each of said contacting surfaces in a longitudinal direction, said at least one paste-receiving groove receiving adhesive paste for sealing the faceplate to the backplate of the flat panel display device; and at least one getter-receiving groove formed adjacent to said at least one paste-receiving groove, said at least one getter-receiving groove receiving a getter that is used for improving a vacuum degree of the flat panel display device.

8. The side bar of claim 7, further comprising a communicating groove through which said at least one getter-receiving groove communicates with an effective area of the flat panel display device that is to realize images.

9. The side bar of claim 8, wherein the communicating groove has a side wall which prevents the getter from deviating from the communicating groove.

10. The side bar of claim 7, further comprising at least one wire-receiving groove extending from the getter-receiving groove and crossing the paste-receiving groove, the wire-receiving groove receiving a metal wire for heating the getter.

11. The side bar of claim 7, wherein said at least one paste-receiving groove has a cross section which comprises one of a wedge-shaped cross section, a semicircular cross section, and a rectangular cross section.

12. The side bar of claim 7, wherein said at least one getter-receiving groove is formed as a unitary groove along the side bar in the longitudinal direction.

13. The side bar of claim 7, wherein said at least one getter-receiving groove comprises a plurality of grooves which are one of circular grooves and rectangular grooves.

14. A method of manufacturing a side bar for sealing a faceplate to a backplate of a flat panel display device, said side bar being disposed between the faceplate and the backplate and maintaining a constant cell gap between the backplate and the faceplate, said method comprising:

providing contacting surfaces confronting facing surfaces of the faceplate and the backplate of the flat panel device; and forming at least one paste-receiving groove and at least one getter-receiving groove adjacent to each said at least one paste-receiving groove on each of the confronting surfaces in a longitudinal direction, each said at least one paste-receiving groove receiving adhesive paste for sealing the faceplate to the backplate of the flat panel display device.

15. The method of claim 14, further comprising:

disposing the adhesive paste in the paste-receiving grooves;

drying the adhesive paste disposed in the paste-receiving grooves; and firing the plate with the disposed adhesive paste.

16. A flat panel display device having a backplate and a faceplate which are facing each other, comprising:

a cathode electrode provided on the backplate;

an emitter provided on the cathode electrode, the emitter emitting electrons when an electric field is formed around the emitter;

an anode electrode provided on the faceplate;

a phosphor layer provided on the anode electrode, the phosphor layer being excited by the electrons emitted from the emitter and emitting light; and a side bar for sealing the faceplate to the backplate while being disposed between the faceplate and the backplate and maintaining a constant cell gap between the two plates;

wherein the side bar comprises contacting surfaces confronting facing surfaces of the faceplate and the backplate, and at least one paste-receiving groove formed on each of the contacting surfaces in a longitudinal direction, said at least one paste-receiving groove receiving adhesive paste for sealing the faceplate to the backplate.

17. The flat panel display device of claim 16, further comprising:

at least one getter-receiving groove formed adjacent to said at least one paste-receiving groove, said at least one getter-receiving groove receiving a getter that is used for improving a vacuum degree of the flat panel display device and being directed to an effective area of the flat panel display device that is to realize images.

18. The flat panel display device of claim 17, further comprising:

a communicating groove through which said at least one getter-receiving groove communicates with the effective area of the flat panel display device that is to realize images.

19. The flat panel display device of claim 17, wherein the communicating groove has a side wall which prevents the getter from deviating from the communicating groove.

20. The flat panel display device of claim 17, further comprising at least one wire-receiving groove extending from said at least one getter-receiving groove and crossing said at least one paste-receiving groove, the wire-receiving groove receiving a metal wire for heating the getter.

21. The flat panel display device of claim 17, wherein said at least one getter-receiving groove is formed as a unitary groove along the side bar in the longitudinal direction.

22. The flat panel display device of claim 17, wherein said at least one getter-receiving groove comprises a plurality of grooves which are one of circular grooves and rectangular-shaped grooves.

23. The flat panel display device of claim 16, wherein said at least one paste-receiving groove has a cross section which comprises one of a wedge-shaped cross section, a semicircular cross section, and a rectangular cross section.

24. The flat panel display device of claim 16, wherein said at least one paste-receiving groove is formed so as to have at least one wall which is open.

25. The flat panel display device of claim 16, wherein the adhesive paste is provided in said at least one paste-receiving groove such that a center portion of the adhesive paste is higher than the contacting surfaces of the side bar, and a circumferential portion of the adhesive paste is lower than the contacting surfaces of the side bar.

26. The method of claim 5, further comprising disposing the adhesive paste in said at least one paste receiving groove such that the adhesive paste has substantially the same height as the contacting surfaces.

27. The method of claim 5, further comprising disposing the adhesive paste disposed in said at least one paste-receiving groove.

28. The method of claim 5, further comprising additionally disposing the adhesive paste on a top surface of the adhesive paste disposed in said at least one paste-receiving groove so as to form protrusions along the top surface of the adhesive paste disposed in said at least one paste-receiving grooves, the protrusions being higher than the contacting surfaces.

29. The method of claim 28, further comprising drying the adhesive paste disposed on the top surface of the adhesive paste disposed in said at least one paste-receiving groove.

30. The method of claim 5, further comprising firing the contact surfaces with the disposed adhesive paste.

31. The method of claim 5, further comprising cutting the contact surfaces into a plurality of units, each unit including at least one paste-receiving groove.

32. The method of claim 14, further comprising cutting the contacting surfaces into a plurality of units, each unit including at least one paste-receiving groove and at least one getter-receiving groove adjacent to said at least one paste-receiving groove.

* * * * *